United States Patent [19]

Ferris et al.

[11] Patent Number: 4,550,917

[45] Date of Patent: Nov. 5, 1985

[54] BOARD RACING GAME

[75] Inventors: Michael J. Ferris, Chicago; Jeffrey D. Breslow, Highland Park, both of Ill.

[73] Assignee: Marvin Glass & Associates, Chcago, Ill.

[21] Appl. No.: 536,376

[22] Filed: Sep. 27, 1983

[51] Int. Cl.[4] ..... A63F 3/00

[52] U.S. Cl. ..... 273/246; 273/284

[58] Field of Search ..... 273/246, 281, 283, 284

[56] References Cited

U.S. PATENT DOCUMENTS

| | | | |
|---|---|---|---|
| 2,010,558 | 8/1935 | Neuzil | 273/246 |
| 3,044,779 | 7/1962 | Huizdash | 273/246 |
| 3,709,498 | 1/1973 | Liston | 273/287 X |
| 3,924,858 | 12/1975 | Dittrich et al. | 273/287 X |
| 4,471,959 | 9/1984 | Rubik | 273/153 S |

FOREIGN PATENT DOCUMENTS

| | | | |
|---|---|---|---|
| 973037 | 10/1964 | United Kingdom | 273/248 |

*Primary Examiner*—Richard C. Pinkham
*Assistant Examiner*—Scott L. Brown

[57] ABSTRACT

A board racing game in which the track includes a number of shiftable straight segments positioned between adjacent fixed segments that are offset with respect with each other fixed curve segments so that the shiftable track may be aligned with either fixed segment. The rules permit a player to shift the track to either assist the advancement of the player's own racing token or to impede the progress of the opponents' tokens. Common blocking pieces movable by any player are also provided for use in impeding the progress of the racing tokens. Each player is provided with a set of cards containing various predetermined moves which the player arranges in the order the player wishes to make the moves. The sets differ from each other by the extent of movement permitted by one card in inverse relationship to the starting position of the player.

16 Claims, 3 Drawing Figures

BOARD RACING GAME

BACKGROUND OF THE INVENTION

1. Field of the Invention

This invention relates generally to board games and more particularly to board games that embody a racing theme.

2. Background Art

Board games, particularly those based on various themes suggested by real live events or occurrences, or by other games, have long been popular. For example, prior art U.S. patents assigned to the assignee of the present invention disclosed board games embodying the themes of: a beauty contest, U.S. Pat. No. 3,861,686; investment, U.S. Pat. No. 3,865,379; invention, U.S. Pat. No. 3,885,792; golf, U.S. Pat. No. 3,989,249; magic act, U.S. Pat. No. 3,989,251; fast food franchises, U.S. Pat. No. 3,994,499; and the legendary creature "BIG FOOT", U.S. Pat. No. 4,128,246. The theme of racing has been used in prior art board games including those of U.S. Pat. Nos. 1,628,073; 1,741,832; 2,128,608; and 2,823,919 respectively. Such prior art games employ chance which, as recognized in U.S. Pat. No. 1,741,832, provides the first racer to start with a substantial advantage, that, with a break in luck usually results in the first player winning. Allowing movement of the player's racing token from lane to lane as in U.S. Pat. No. 2,823,919, provides the player with an opportunity to use foresight and judgement in the passing and blocking of competitors. In addition, the game of U.S. Pat. No. 2,823,919 provides the "favorite" and the "long shot" handicaps at start of the race. There remains, however, a need for a racing board game that provides entertaining, challenging, and competitive play of a racing game in which the players, within prescribed limits, determine the order and extent of their moves and use strategy to affect the progress of the overall race in addition to that of their own racing token.

SUMMARY OF THE INVENTION

The present invention is concerned with providing a portable board racing game for competitive play in which a player is permitted to determine, within limits, the order and extent of the moves to be taken each round, including moves to block or obstruct opponents' advancement as well as to further the player's own advancement. These and other objects and advantages of the invention are achieved by a board game with a board having a race course track including sets of first, second, and third segments arranged such that the first and third segments are offset with respect to each other and the second segment is between the first and the third with one end adjacent the first segment and the other end adjacent the third segment. The second segment is shiftable between a first position in which its one end is aligned with the first segment and a second position in which the other end is aligned with the third segment. In addition to each player's own racing token one or more pieces are provided for movement by any of the players to block the racing tokens. Each player is provided with a set of cards having the available moves indicated on one face. At the beginning of each round each player is permitted to arrange the cards in the order the player wishes to make the moves during that round. Although the available moves are similar in each set of cards the sets are weighted to provide advantage in inverse relationship to the starting order.

BRIEF DESCRIPTION OF THE DRAWINGS

For a better understanding of the present invention reference may be had to the accompanying drawing in which.

DETAILED DESCRIPTION OF THE PREFERRED EMBODIMENT

Figure 1:
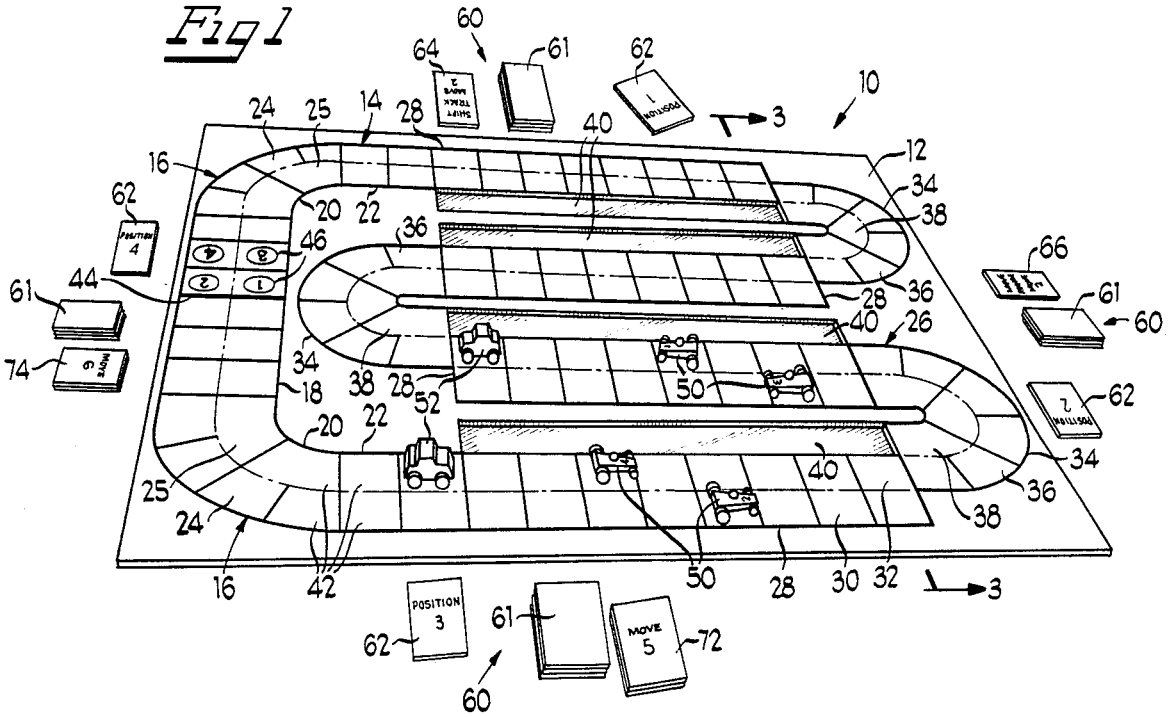
FIG. 1 is a perspective view of an embodiment of the present invention.
Figure 2:
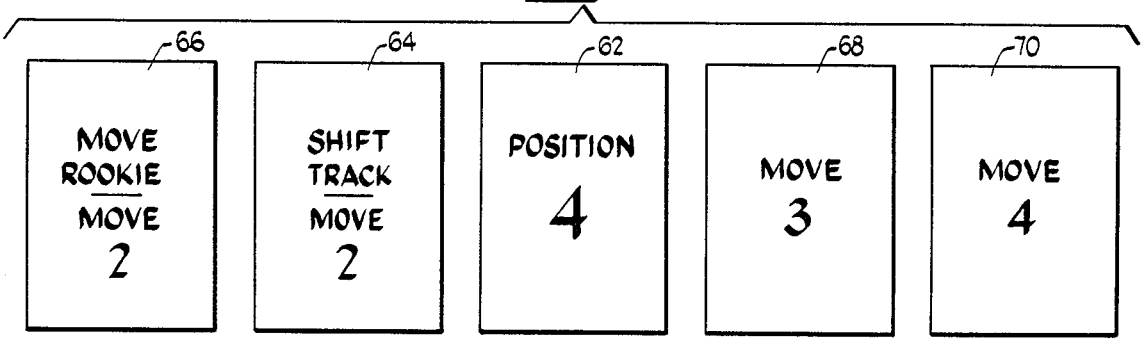
FIG. 2 is an enlarged view of faces of cards in one player's set.

Referring now to the drawing in which like parts are designated by like reference numerals throughout the several views, there is shown in FIG. 1 a board game 10 which includes a game board 12. The upwardly facing playing surface of the game board has a continuous closed race track 14 which comprises a series of adjoining double lane segments. A stationary "C" shaped portion 16 of the track includes a central start/finish straightaway 18 with a right angle curve 20 at either end and a short straightaway portion 22 after each of the right angle curves. The "C" shaped portion has an outer lane 24 and an inner lane 25. Serpentine portion 26 connects the two ends 22 of the "C" 16 and completes the closed circuit of the track 14. Portion 26 comprises alternating shiftable straightaways 28 with parallel lanes 30 and 32 plus stationary intermediate "U" shaped curves 34 each of which have an outside lane 36 and an inside lane 38. Each of the stationary "U" shaped curves 34 are offset with respect to the next successive stationary portion of the track 14 by one lane. Thus the inside lane 25 of the "C" shaped portion is aligned with the outside lane 36 of the adjacent "U" shaped curve 34. Similarly, the outside lane 36 of one "U" shaped curve 34 is aligned with the outside lane 36 of the next "U" shaped curve in the serpentine portion 26, but the inside lanes 38 of those curves are not aligned.

Figure 3:
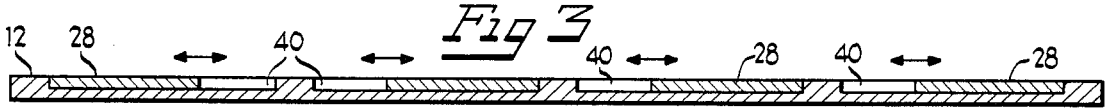
FIG. 3 is an enlarged sectional view taken substantially along the line 3—3 of FIG. 1.

The four shiftable straightaways 28 are contained in recesses 40 formed in the board 12 with the recess substantially conforming to the length of the straightaway 28 but being slightly larger so as not to bind the straightaway segment 28 during movement and the recess is about or slightly more than one lane wider than the width of the straightaway segment 28 as is best shown in FIG. 3. Thus a straightaway 28 may be shifted within the recesses 40 laterally, or transverse to their length as indicated by the arrows in FIG. 3, a distance of one lane from one side to the other to line up one end of the straightaway with the adjoining end 22 of the "C" shaped portion 16 or an end of a "U" shaped curve 34 with the opposite end of the straightaway being offset from the end of the adjacent "C" shaped portion or "U" shaped curve by one lane. Accordingly, as illustrated in FIG. 1 there always exists a single lane serpentine track connecting the ends 22 of the "C" shaped portion 16. However, depending on the lateral position of the shiftable straightaways 28 entrance to or exit from one of the two parallel lanes on each straightaway will be obstructed.

Each of the lanes in the curved and straight segments of the track 14 are divided into single move spaces 42. In the curved sections the inside lanes are provided with half as many spaces 42 as the outside lanes. Accordingly, in the right angle curves 20 the inside lanes 25 only have two spaces while the outside lanes 24 have four spaces and in the "U" shaped curves 34 the outside lanes 36 have six spaces while the inside lanes 38 have three spaces. The lesser number of spaces 42 in the inside lanes of the curves conforms to the advantage achieved by staying in the inside lane of a curve in an actual race and also facilitates maintaining a suitably sized space on the inside lane of the curves. In the start/finish straightaway 18 of the "C" shaped portion 16 a block of four of the spaces 42 is marked with starting position "1" through "4", with number "1" having the most advantageous starting position of the inside lane space nearest the starting line 44. The starting position indicia 46 are color coded in addition to bearing the numerals "1" through "4". Each player is allocated a movable marker or token 50 in a shape of a racing car that bears both numeric and color indicia corresponding to the player's starting position. Two additional "rookie" car pieces 52 distinguished from the players' tokens 50 by their shape and possibly by further differentiating color and/or numbers, are movable by any player and provided for use as blocking pieces to impede the advancement of the racing tokens 50.

Instead of chance means such as a die or spinner for determining movement, each player is assigned a stack or deck of cards 60 having backs 61 of a color corresponding to the player's starting position. One chance element in the game involves determination of the starting position for which four position cards 62 are provided which all have the same back but have different faces with numbers and colors corresponding to the indicia 46. At the start of the game the position cards may be shuffled and dealt out to the players to determine the starting positions "1" through "4". The deck of cards for each player is similar but contains at least one card that is different.

Each deck 60 contains two "Shift Track/Move 2" cards 64, a "Move Rookie/Move 2" card 66, and three "Move" cards with a numeric indicia such as "Move 3" card 68 and "Move 4" 70, "Move 5" 72 or "Move 6" 74. In this embodiment each deck includes a "Move 3" card 68 and a "Move 4" card 70 plus one other "Move" card which differs by one in inverse relationship to the starting position. It has been found convenient to provide the first position player with another "Move 3" card 68, the second position with an additional "Move 4" card 70, the third player with a "Move 5" card 72 and the last or fourth player with a "Move 6" card 74, thus giving the player with the later starting position an opportunity to overcome that handicap.

Once the respective starting positions are determined by dealing out or picking the position cards 62, each player is preferably seated so that the players are in a clockwise order according to their starting position and each player is given a deck of cards corresponding to the starting position. Position cards 62 are not involved in the play of the game after the starting positions are determined. The player arranges or stacks the six cards in the order that the player wishes to make moves during the coming round. For example, the player in the first starting position would probably play a "Move 3" or "Move 4" card 68 or 70 respectively at the onset when the track is clear. As a next move, in anticipation of being blocked by a rookie car piece 52, the player in the first position may want to play "Move Rookie/-Move 2" card 66. Once the player arranges the deck in a particular order for the round the deck may not be rearranged until after all of the players have played all of the cards to conclude a round. If a player has a card come up that can not be fully played, as for example, if the leading player shown in FIG. 1 were to turn up a "Move 4" card 70, the player is only able to take three moves forward and the fourth move would be wasted since advancement is blocked by a piece 52. In that situation, the player would be permitted to move laterally to the parallel lane as a fourth move but since that lane is out of line with the lane of the curve 28, the move would be useless unless the player has a "Shift Track/Move 2" card 64 coming up next or anticipates the another player will shift the straightaway segment 28 before the "Rookie" 52 is moved.

A player may move from one lane to another on straightaways using up one move to which the player is entitled, however, the players may not change lanes on the curves. The "rookie" drivers 52 may be placed on any straightaway space 42 but not on curves. Shifting of the movable straightaway segments 28 may be employed offensively or defensively as long as players are on that shiftable segment or able to enter onto the segment in the next turn. Once the six cards have been played, the players are permitted to again rearrange their respective decks for the next round. As an alternative, the players may exchange decks at the end of each round based on their position at the end of that round. Thus, the second and third position players as shown in FIG. 1 would exchange decks. Generally the first player to cross the finish line 44 wins although the game could be extended for multiple laps or circuits of the track 14.

While a particular embodiment of the present invention is shown and described with an alternative modification, other changes and modifications will occur to those skilled in the art. It is intended in the appended claims to cover all such changes and modifications as fall within the true spirit and scope of the present invention.

What is claimed as new and desired to be secured by Letters Patent is:

1. A board racing game comprising:

a game board having a track first, second, and third segments;

the first and third segments being offset with respect to each other;

the second segment being intermediate the first and third segments with one end of the second segment adjacent the first segment and the other end adjacent the third segment;

the second segment being shiftable between a first position in which the one end is aligned with the first segment and a second position in which the other end is aligned with the third segment;

player tokens positionable on the segments for movement along the track; and means for determining the movement of the player tokens.

2. The board game of claim 1 in which the track has multiple lanes.

3. The board game of claim 2 in which at least one lane of the second segment is aligned with at least one lane of each of the first and third segments in both the first and second positions.

4. The board game of claim 1 in which the first and third segments are permanently fixed on the board.

5. The board game of claim 1 in which the first and third segments are substantially curved segments of the track and the second segment is a straightaway.

6. The board game of claim 1 in which the track is a continuous closed course.

7. The board game of claim 1 in which the track includes a serpentine portion with the first and third segments being curved and the second being a straightaway.

8. The board game of claim 1 in which the movement determining means comprises a set of move indicating cards for each player.

9. The board game of claim 8 in which the cards are arrangeable by the player to determine the order of the moves.

10. The board game of claim 8 in which each set of cards differs by at least one card.

11. The board game of claim 10 in which the sets of cards include a least advantageous set of cards that is allocated to the first starting player and each succeeding player is allocated a progressively more advantageous set.

12. The board game of claim 1 including blocking pieces movable by each player to impede the advancement of the player tokens.

13. A board game for a plurality of players comprising:

a game board including a track having a start and a finish;

the track including first, second, and third multiple lane segments;

the first and third segments being offset with respect to each other by at least one lane;

the second segment being intermediate the first and third segment with one end of the second segment being adjacent the first segment and the other end being adjacent the third segment;

the second segment being shiftable between a first position in which the one end is aligned with the first segment and a second position in which the other end is aligned with the third segment;

token means for each player movable along the track; and a set of predetermined moves arrangeable by the players to determine the order of the moves.

14. The board game of claim 13 in which each player's set of moves is different by at least one move.

15. The board game of claim 14 including means indicating the starting position of each player including a first starting position for one of the players and in which the sets of moves include a least advantageous set of moves that is allocated to the player having the first starting position and each succeeding starting position is allocated a progressively more advantageous set.

16. The board game of claim 13 including blocking pieces movable by each player to impede the advancement of the player tokens.

* * * * *